US006739652B2

(12) United States Patent
Welsh

(10) Patent No.: US 6,739,652 B2
(45) Date of Patent: May 25, 2004

(54) BEVERAGE HOLDER

(76) Inventor: Kerry L. Welsh, 4455 Torrance Blvd., #139, Torrance, CA (US) 90503

( * ) Notice: Subject to any disclaimer, the term of this patent is extended or adjusted under 35 U.S.C. 154(b) by 0 days.

(21) Appl. No.: 10/123,439

(22) Filed: Apr. 16, 2002

(65) Prior Publication Data

US 2003/0193222 A1 Oct. 16, 2003

(51) Int. Cl.[7] ..... A47C 13/00
(52) U.S. Cl. ..... 297/129; 297/188.14
(58) Field of Search ..... 297/118, 129, 297/188.14, 188.15, 188.2; 248/345.1, 311.2, 314

(56) References Cited

U.S. PATENT DOCUMENTS 4,697,780 A * 10/1987 Wenkman et al. ..... 248/558
5,234,251 A * 8/1993 Ayotte ..... 297/188.14
5,279,452 A * 1/1994 Huynh ..... 224/482
5,533,782 A * 7/1996 Goldman ..... 297/188.18
5,536,064 A * 7/1996 MacLean ..... 297/129
5,588,696 A * 12/1996 Jay et al. ..... 297/129
5,597,148 A * 1/1997 Gospodarich ..... 248/311.2
5,695,162 A * 12/1997 DiCastro ..... 248/231.81
6,056,172 A * 5/2000 Welsh ..... 224/155
6,227,511 B1 * 5/2001 De Costa ..... 248/311.2
6,325,350 B1 * 12/2001 Mancuso ..... 248/311.2
6,361,105 B1 * 3/2002 Turner et al. ..... 297/23
6,371,428 B1 * 4/2002 Zorich et al. ..... 248/311.2
6,457,772 B1 * 10/2002 Forston ..... 297/188.14

* cited by examiner

*Primary Examiner*—Peter M. Cuomo
*Assistant Examiner*—Stephanie Harris
(74) *Attorney, Agent, or Firm*—Blakely Sokoloff Taylor & Zafman LLP

(57) ABSTRACT

An apparatus including receptacle having an opening with dimensions suitable for accommodating a beverage container having a volume suitable for consuming of a beverage in a single seating; and a fastening member coupled to the receptacle and having a protruding portion representatively adapted to be coupled to an armrest of a chair.

6 Claims, 5 Drawing Sheets

BEVERAGE HOLDER

BACKGROUND

1. Field

The invention relates to a container unit and apparatus including a container unit.

2. Background

In recent years, the convenience and utility arose for having a folding chair that can be carried around to different locations such as the beach, the park, and sporting events. U.S. Pat. No. 6,056,172 describes a folding chair made up of preferably lightweight U-shaped metal alloys or plastic with straps coupled to a panel to allow a user to wear the chair on his or her back. A pouch is also coupled to the same or another support panel to allow a user to carry or store articles in the pouch.

DETAILED DESCRIPTION

An apparatus is disclosed. The apparatus, in one embodiment, is suitable for use as a beverage holder comprising a material formed in a body having an opening with dimensions suitable for accommodating a beverage container. In one embodiment, the dimensions are suitable for a beverage container having a volume suitable for consuming a beverage in a single seating, such as a 12 or 16 ounces (oz.) can of soft drink or juice. The apparatus also includes a fastening member coupled to the body material and having a protruding portion adapted, in one embodiment, to be connected (directly or indirectly) to an armrest of a chair.

Figure 1:
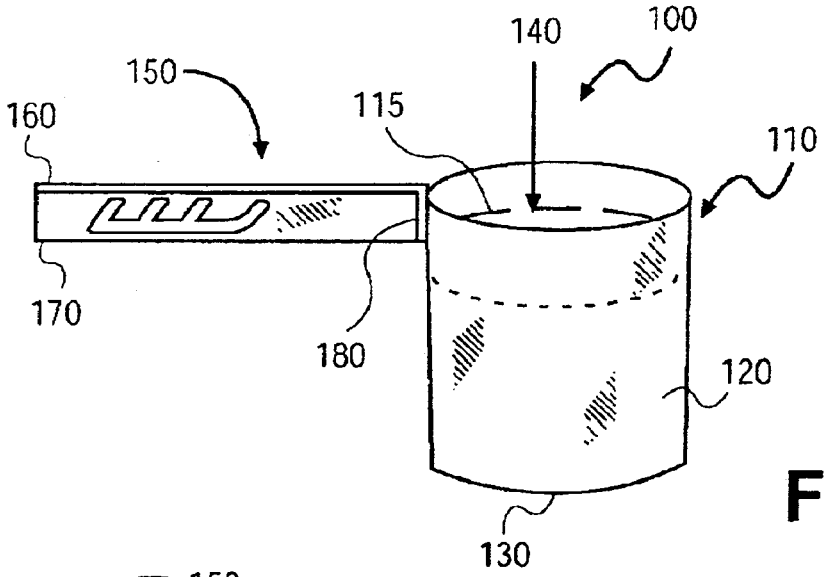
FIG. 1 is a side, partial perspective view of an embodiment of an apparatus suitable for use as a beverage holder.
Figure 2:
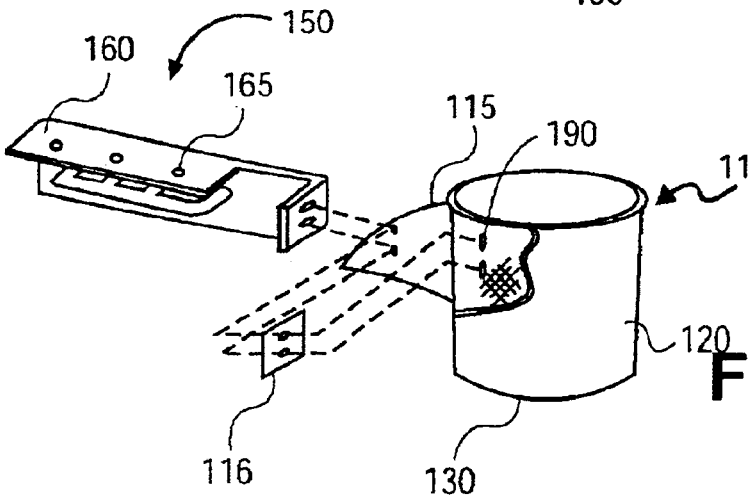
FIG. 2 is a top side perspective and partial cut-away view of the apparatus of FIG. 1.
Figure 3:
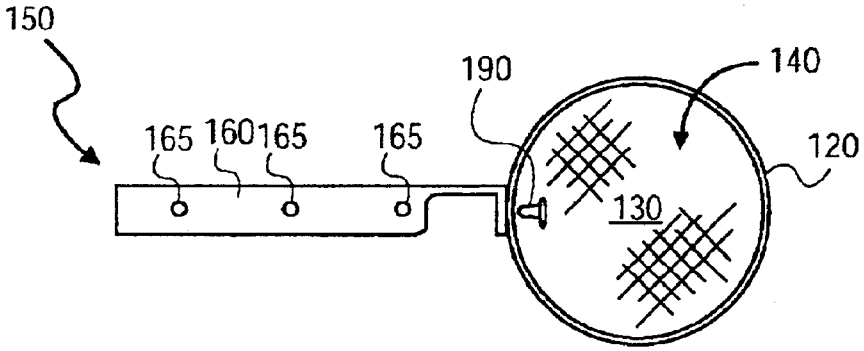
FIG. 3 is a top view of the apparatus of FIG. 1.

FIG. 1, FIG. 2, and FIG. 3 show an embodiment of an apparatus suitable for holding or storing a beverage container. Apparatus 100 in this one embodiment is suitable for use in conjunction with an adjustable position chair. Apparatus 100 includes receptacle 110. Receptacle 110 is preferably lightweight and is deformable (e.g., collapsible), such that its shape may be established by containing an article within receptacle 110, but when empty, the shape may be modified (e.g., deformed). Suitable material for receptacle 110 includes, but is not limited to, a polymer such as a nylon or polyester fibers or cloth fibers. Alternatively, receptacle 110 may be of a hard plastic material or other solid body material that is not collapsible or not readily collapsible. Receptacle 110 is formed in the shape of a container having body portion 120 and base portion 130. Body portion 120 is formed in a tubular configuration having dimensions suitable, in one example, to hold a typical beverage container, such as a cup, a 12 or 16 ounce (oz.) soda can, or a juice or water bottle. Receptacle 110 also includes, in one embodiment, base or bottom portion 130. Base or bottom portion 130 is of a similar material as body portion 120 and, in the case of cloth or other collapsible polymer material, body portion 120 and base portion 130 may be coupled together though stitching with a suitable durable thread. Alternatively, base portion 130 may be of a different material than body portion 120 or, in the case of a cloth or polymer fiber, may be of a different weave. For example, body portion 120 may be constructed of fibers woven together tightly as a unitary body, while base portion 130 may be constructed of fibers woven together more loosely to form a web with openings therethrough. Collectively, body portion 120 and base portion 130 define interior volume 140 for containing a portion of a receptacle.

Collectively, body portion 120 and bottom or base portion 130 define a volume 140 suitable for containing a portion of a beverage container. Representatively, body portion 120 is cylindrical in shape and has a length on the order of about three to four inches and a diameter on the order of about three to four inches. FIG. 1 also shows body portion 120 having lip portion 115 formed by folding over a superior portion (as viewed) of body portion 120 and stitching the folded over portion to the remainder of body portion 120. In one embodiment, stiffner 116 is placed within the fold of lip portion 115. Stiffner 116 is, for example, a hard plastic material.

Referring to FIG. 1, FIG. 2, and FIG. 3, the beverage holder apparatus also includes a fastening member to, for example, fasten the material portion to a suitable object. One suitable object is an outdoor chair, such as a folding chair with adjustable seating positions provided at the armrests. An example of a suitable object is a folding chair that can be carried as a backpack, such as the backpack chair disclosed in U.S. Pat. No. 6,056,172. Referring to the apparatus shown in FIG. 1, FIG. 2 and FIG. 3, the apparatus is suitable, in one embodiment, for coupling to an armrest of the described backpack chair.

Fastening member 150 is, in one embodiment, of a hard plastic or metal material formed, as viewed, of an inverted L-shaped body having, horizontal or base portion 160 and vertical portion 170. At one end of fastening member 150 and coupled to base portion 160 and vertical portion 170 is lateral or side portion 180. An angle between vertical portion 170 and lateral or side portion 180 is representatively 90°, and an angle between vertical portion 170 and horizontal or base portion 160 is representatively 90°. One side of lateral or side portion 180 provides a face for coupling to body portion 120 of receptacle 110. In one embodiment, horizontal or base portion 160, vertical portion 170 and lateral or side portion 180 are formed as a single unit by, for example, molding a hard material such as a metal (e.g., steel or aluminum) or a hard (dense) plastic or polymer material. In the case of a metal, such as aluminum or steel, the portions may be formed as individual components and coupled together through welds or similar means.

Fastening member 150 is coupled to material portion 100 (through body portion 120) by one or more screws or rivets between body portion 120 and lateral or side portion 180. FIG. 2 and FIG. 3 show, as an example, rivets 190 separated (exploded) from coupling body portion 120 of receptacle 110 to lateral or side portion 180 of fastening member 150. In one embodiment, screws or rivets 190 are placed from inside (interior volume 140) out—through body portion 120, through stiffner 116, through lip portion 115, through lateral or side portion 180. Fastening member 150 further includes, in one embodiment, openings 165 on horizontal portion 160, to fasten the apparatus to a suitable object.

Figure 4:
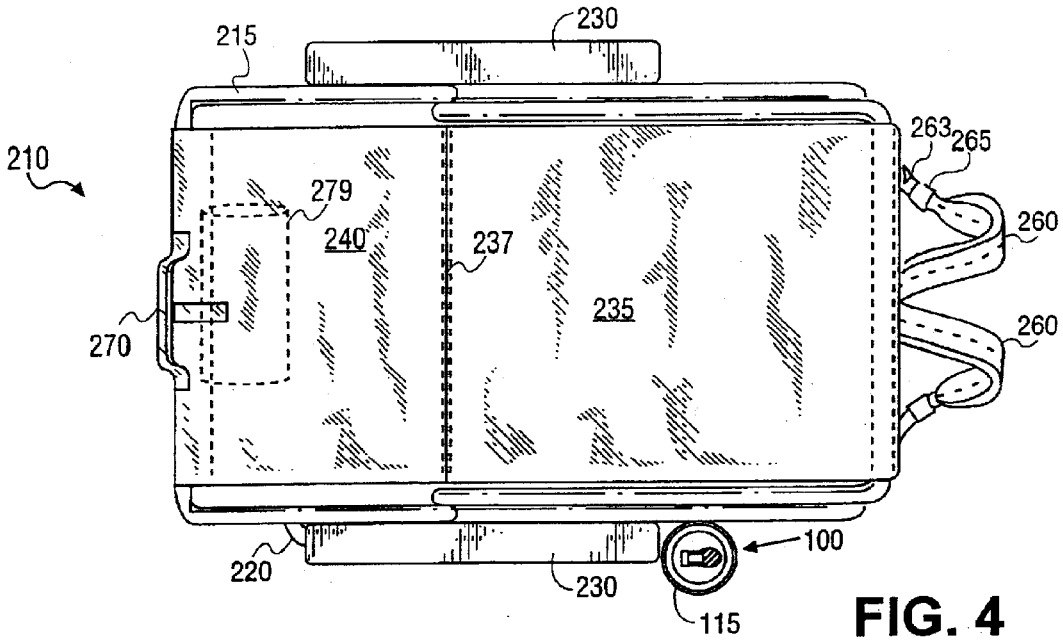
FIG. 4 is a top view of the apparatus of FIG. 1 coupled to a front side view of an embodiment of the backpack unit.
Figure 5:
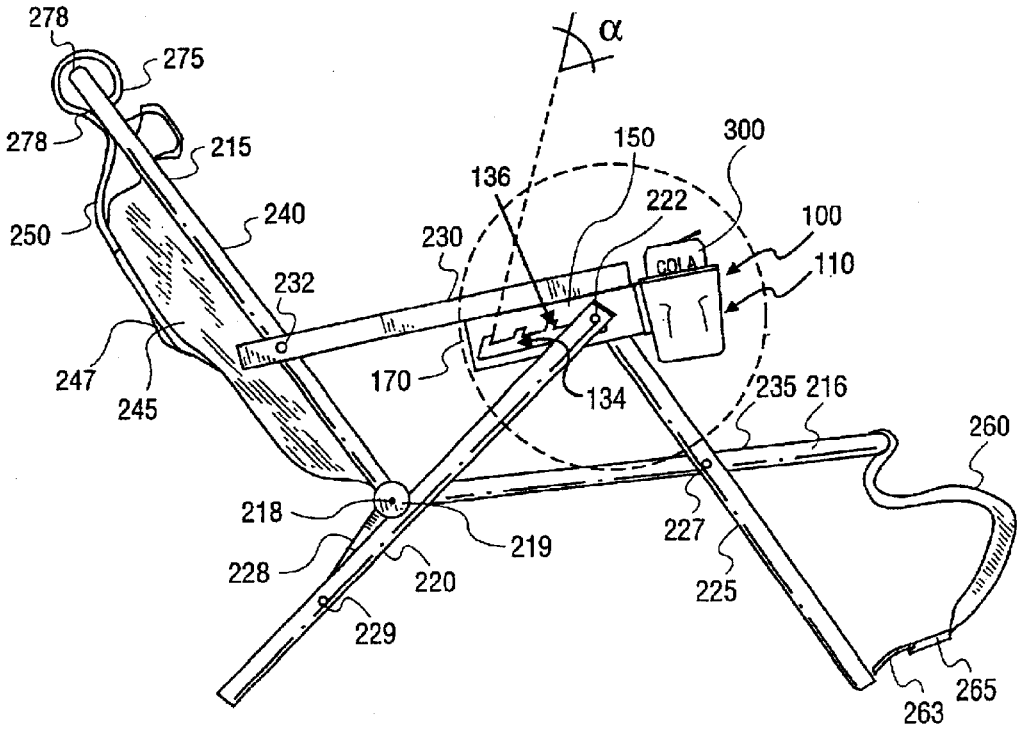
FIG. 5 is a side view of the assembly of FIG. 4.

FIG. 4 shows a planer top view of a backpack unit that may be used as a chair. FIG. 5 shows a side view of the backpack unit of FIG. 4. In the embodiment shown in FIG. 4 and FIG. 5, the backpack unit has the apparatus described with reference to FIG. 1, FIG. 2 and FIG. 3 coupled to an armrest (e.g., fastening member 150 is coupled to an armrest by screws (wood screws) through openings 165 in base portion 160).

In the embodiment shown in FIG. 4 and FIG. 5, backpack unit 210 consists of a frame in the form of a folding chair. The frame is of a lightweight material including, but not limited to, metal alloy or plastic.

Suitable metal alloys include but are not limited to aluminum, aluminum alloy, steel, and steel alloy. The frame includes U-shaped seat frame 216 pivotally coupled at its ends to the ends of U-shaped back frame 215 through cross-member 218. In this manner, U-shaped back frame 215 is adapted to rotate about cross-member 218. Cross-member 218 is for example a lightweight metal alloy rod that extends the width of U-shaped back frame 215 and is coupled to the ends of U-shaped back frame 215 and U-shaped seat frame 216. The frame also includes U-shaped front leg frame 225 coupled at its ends to the ends of U-shaped back leg frame 220 through separate cross-members 222 to form a rotational axis. Cross-members 222 are, for example, cylindrical rivets, screws, bolts, or other suitable fasteners. Cross-members 222 are coupled at respective ends of U-shaped front leg frame 225 and U-shaped back leg frame 220. In one embodiment, each of back frame 215, seat frame 216, and back leg frame 220 have different widths and the width of front leg frame 225 and back frame 215 are substantially similar. In this manner, in a folded state, each of the components of the frame are substantially parallel and adjacent to one another with back leg frame 220 being widest, followed by back frame 215 and front leg frame 225, and seat frame 216.

In one embodiment, front leg frame 225 is rotatably coupled to seat frame 216 at point 227 substantially between the ends and the apex of front leg frame 225 and the ends and apex of seat frame 216. In one embodiment, concave-shaped rollers 219 extend from the end of cross-member 218. Concave-shaped rollers 219 are configured to abut back leg frame 220 when back frame 215 of the frame is in an unfolded state. In this manner, cross-member 218 supports back frame 215 by displacing a downward force onto back leg frame 220 to limit the rotation of back frame 215 about cross-member 218. Support members 228 may be added to either side of the back leg frame 120 and coupled to cross-member 218 to further support back frame 215 when the frame is in an unfolded state.

Figure 6:
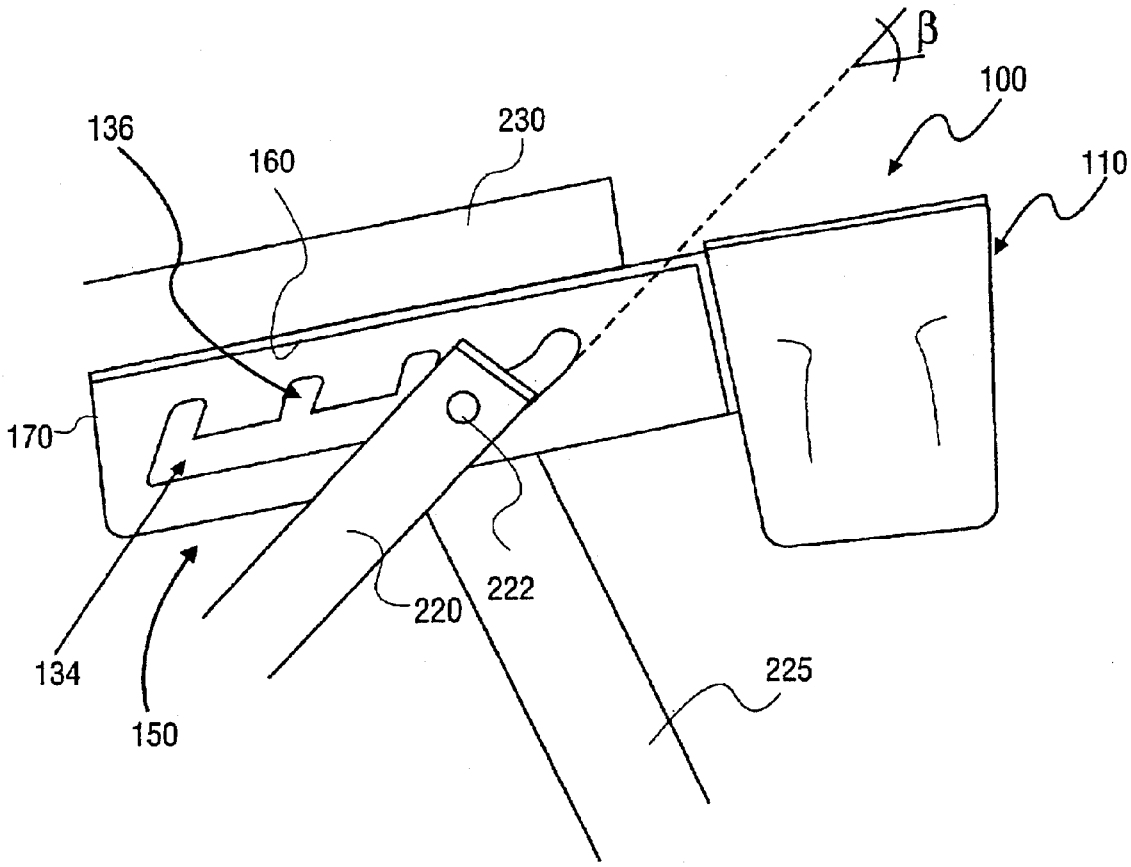
FIG. 6 is a magnified, side view of the apparatus of FIG. 1 coupled to an armrest of a backpack unit.

The frame of the backpack unit of the invention also includes a pair of armrests 230 pivotally coupled at one end to back frame 215 and positionally coupled to the ends of back leg frame 220 and front leg frame 225. The armrests are made of a durable material that is comfortable to the exposed arms of a user. Suitable material includes, but is not limited to, plastic and wood. In one embodiment, inferiorly extending plates are coupled to the base of each armrest 230 and individually coupled to cross-members 222 between the outer back leg frame 220 and the inner front leg frame 225. As illustrated in FIG. 5 (and magnified in FIG. 6), at least one of the plates is a beverage holder apparatus such as apparatus 100. Apparatus 100 includes vertical portion 170 of fastening member 150 having opening 134 substantially extending about vertical portion 170 with a plurality of laterally extending openings 136 branching from opening 134 at an approximate 30°–90° angle (see angle $\propto$, FIG. 5). Optionally, openings need not extend at the same angle. Referring to FIG. 6, for example, the opening closest to receptacle 110 defines a smaller angle, $\beta$, than the other openings in vertical portion 170 ($\beta<\alpha$) so that back frame 215 reclines more in this position than in another position. Base portion 160 of apparatus 100 is fastened to one armrest 230 by, for example, one or more screws through openings 165. One cross member 222 may be disposed through opening 134 (or one opening 136) to position back frame 215. In this example, receptacle 110 includes or contains a beverage container, such as a 12 oz. soft drink container 300. In an embodiment where only one of the plates is a beverage holder apparatus, the other plate may be formed as an inverted L-shaped member with a base portion coupled to a second armrest 230 and a vertical portion having an opening (s) corresponding to opening 134 and openings 136 of apparatus 100 similar to the plate(s) shown in U.S. Pat. No. 6,056,172.

Armrests 230 are rotatably coupled substantially about midpoint a between the apex and ends of back frame 215. The rotatable coupling allows armrests 230 to collapse and be rotated so that when the chair is in a folded state, armrests 230 are substantially parallel to back frame 215.

In addition to the frame of the backpack unit, the unit includes at least one panel to support a user seated within the frame. In one embodiment, the panel is made of a durable material such as canvas (e.g., 600 Denier canvas), or polyester, or other cloth or cloth-like material. The panel is coupled to the apex of back frame 215 and the apex of seat frame 216. The coupling may be accomplished by looping the panel material, for example, over the apex of back frame 215 and sewing the looped portion to the back side of the panel. A similar sewing procedure may be used to couple the panel to the apex of seat frame 216. In one embodiment, the panel is made up of seat panel 235 and back panel 240. Seat panel 235 is coupled, such as described above, to the apex of seat frame 216. Seat panel 235 is also coupled at its other end (237) in a similar fashion to cross-member 218 and is coupled at a tension to support an average user of the frame as a chair. Back panel 240 is coupled, such as described above, to the apex of back frame 215 and is coupled at its other end to seat panel 235, such as for example, by sewing. Back panel 240 and seat panel 235 are coupled at a tension to support an average user of the frame as a chair.

In one embodiment, a head rest is provided along the apex of back frame 215. Head rest 278 is, for example, a foam such as a polystyrene foam, extending above the apex of back frame 215 and beneath back panel 240. Head rest 278 cushions the head or shoulder of a user seated in the frame. Optionally, head rest cushion 279 of a pillow, sized to support the head of a user and filled with a polystyrene foam or other suitable material, may be coupled to the front side of back panel 240 at a position suitable for contacting the head of an individual reclining within the frame.

Coupled to the back side of back panel 240, in one embodiment, is container unit 245. In one embodiment, container unit 245 is made of the same material as the panel (i.e., seat panel 235 and back panel 240). Container unit 245 is configured to provide an opening between container unit 245 and the back side of back panel 240. In one embodiment, container unit 245 contains a sufficient cavity or container to allow the storage and transport of various goods, such as sporting equipment and picnic supplies. Overlying container unit 245 and coupled, in one embodiment, to back panel 240 is container flap 250. Container flap 250 should be of a sufficient area to extend over the opening defined by container unit 245. In one embodiment, container flap 250 may be detachably coupled to container unit 245 by providing releasable fasteners such as male/female snap-release buckles 247 connected or coupled, such as for example, by sewing to each of container flap 250 and container unit 245.

Coupled to a back side of seat panel 235 (as viewed), in this embodiment, are a pair of adjustable straps 260. In one embodiment, the top of the straps 260 are coupled such as, for example, by sewing at a point adjacent the apex of seat frame 216. A second end of straps 260 are coupled adjacent to the apex of front leg frame 225. Straps 260 typically have a cushion element and a strap element 263. Straps 260 are adjustable through a conventional buckle 265 such as used in other lightweight backpack configurations. Straps 260 allowed the chair to be carried as a backpack, over the shoulders of an individual, which the chair is in folded state.

In the embodiment shown in FIGS. 4–6, one end of fastening member 150 (with lateral or side portion 180) is aligned roughly with an end of one armrest 230. In this manner, receptacle 110 is located adjacent, and appears to extend from, armrest 230. Representatively, the superior surface of body portion 120 (e.g., lip portion 115) is linearly aligned with a superior surface of armrest 230. In another embodiment, fastening member 150 may be adjustable, such as providing fastening member 150 of a multi-component unit with, for example, base portion 160 and vertical portion 170 coupled together as one piece and lateral portion 180 having an adjustable tongue portion extending along a length of base portion 160 and capable of hooking into protruding notches on the inferior side of base portion 160, such as by a key-hole lock assembly. It is also appreciated that fastening member 150 need not serve as a plate having openings (e.g., opening 134 and opening 136) to provide for adjustment of a back frame of a folding chair (e.g., back frame 215). In the embodiment shown in FIGS. 4–6, for example, fastening member 150 may be connected (possibly detachably connected) to a separate plate having the openings for adjustment of back frame 215.

Figure 7:
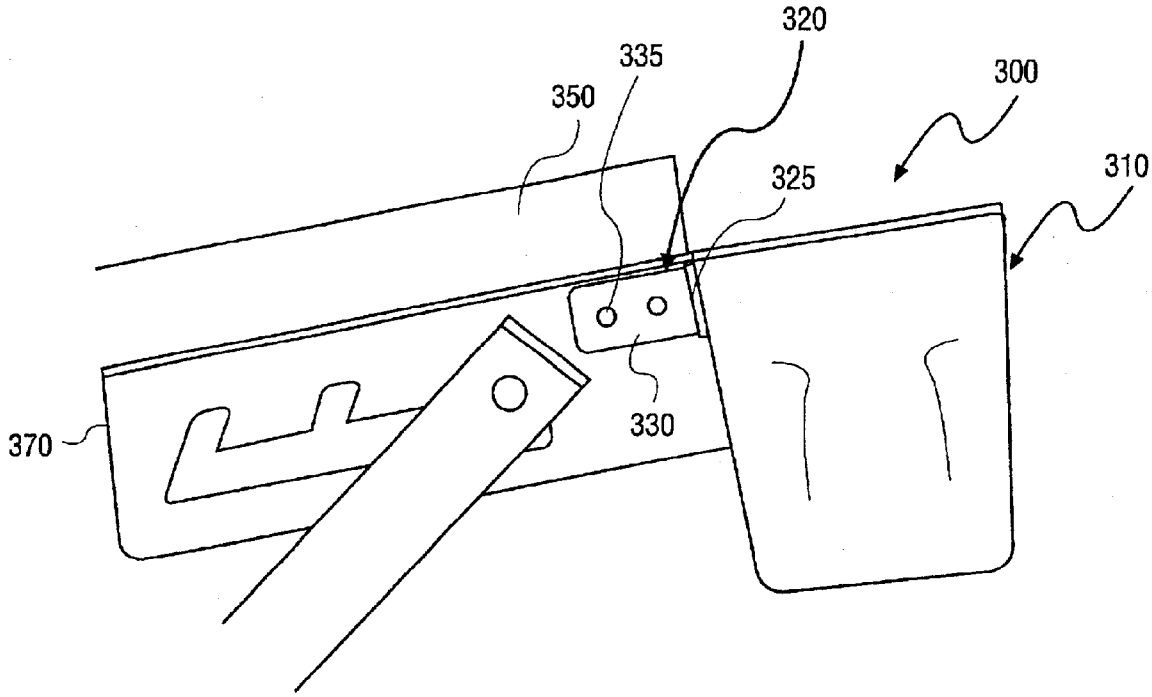
FIG. 7 is a magnified, side view of a second embodiment of the apparatus coupled to an armrest of a folding chair.

FIG. 7 shows another embodiment of a beverage holder apparatus coupled to a portable folding chair. In this embodiment, apparatus 300 includes receptacle 310 and fastening member 320. Receptacle 310 may be as described above with regard to receptacle 110. Fastening member 320 is an L-shaped body having base portion 325 and length portion 330. Receptacle 310 is coupled to one side of base portion 325 (the side opposite length portion 330) by, for example, a rivet, screw, or adhesive. Length portion 330, in this example, is coupled to one side of vertical portion 370 that is positioned between, for example, ends of a U-shaped back leg frame and a U-shaped front leg frame, and has diagonal openings for positioning a back frame of a chair. In this embodiment, length portion is coupled to vertical portion 370 by screws or rivets 335. Vertical portion 370 having recline slots is coupled to armrest 350. In another embodiment, where, for example, the chair does not have a recline mechanism (e.g., no positioning portion with recline slots), the base portion of the fastening member may be coupled to the underside of an armrest similar to connecting fastening member 150 to arm rest 230 in FIG. 5 and FIG. 6.

Figure 8:
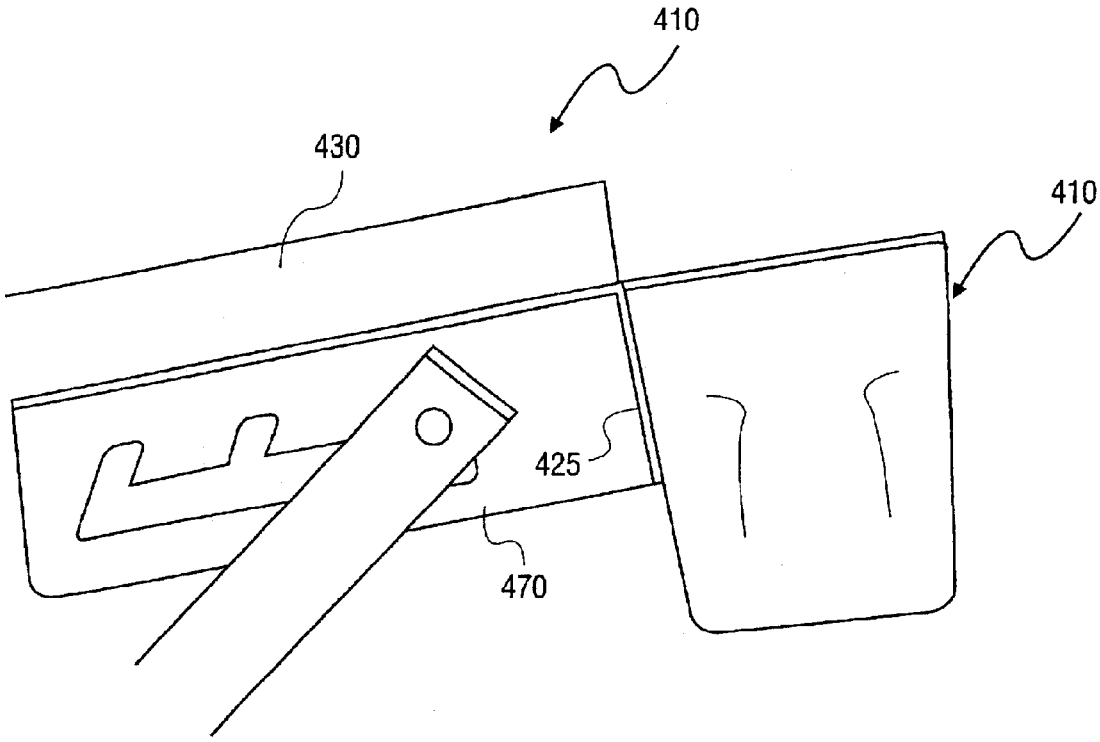
FIG. 8 is a magnified, side view of a third embodiment of the apparatus coupled to an armrest of a folding chair.

FIG. 8 shows still another embodiment where armrest, a vertical portion, and a fastening member for a receptacle are formed of a single piece of material such as a single piece of molded plastic. In this embodiment, armrest 430, vertical portion 470 having recline slots, and fastening member 425 are formed of a single material. Vertical portion 470 is positioned between, for example, ends of a U-shaped back frame and a U-shaped front leg frame. Fastening member 425 includes a portion, in this example, extending out of the page as viewed, providing an area for receptacle 410 to be coupled to fastening member 425 by screw, rivet, or adhesive.

By making an apparatus suitable as a beverage holder of a collapsible, light-weight, durable material, the apparatus is suitable for carrying, along with the chair, via a backpack unit as described. It is appreciated, however, that the apparatus described as a beverage holder may be made of other heavier or non-flexible material and used in a similar manner, perhaps with a backpack unit such as shown or a stationary chair. It is also appreciated that apparatus 100 may have a variety of uses beyond a place to store beverages. Such uses include, storing other goods like writing utensils, lotions, snack foods, and other items.

In another embodiment, container 110 may enclose, within a body of container 110 (and possibly base 130) an insulated material to insulate beverages.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. A backpack unit comprising:

a frame of a material selected from one of a metal alloy and a plastic in the form of a folding chair including a U-shaped seat frame pivotally coupled at its ends to ends of a U-shaped back frame through a cross-member, a U-shaped front leg frame pivotally coupled to the seat frame and pivotally coupled at its ends to ends of a U-shaped back leg frame, the frame capable of being folded such that the back frame, the seat frame, the front leg frame, and the back leg frame fold substantially parallel and adjacent to one another;

a pair of armrests pivotally coupled to the back frame and positionally coupled along a first diagonal between the ends of the front leg frame and the back leg frame, the pair of armrests each having a first side and an opposite second side, wherein the first side is positioned so that the first side may come in contact with an arm of a person seated on the seated frame;

a fastening member coupled to the second side of the one of the pair of armrests, and including an end portion extending beyond an end of the one of the pair of armrests;

a receptacle coupled to the end portion of the fastening member, the receptacle having an opening with dimensions suitable for accommodating a beverage container having a volume suitable for consuming a beverage in a single seating;

a first support panel coupled about the back frame and the seat frame and associated with the cross-member;

a second support panel coupled to the first support panel;

shoulder straps coupled to the second support panel; and a container having a forward wall panel coupled to the back side of the first support panel adjacent the back frame.

2. The backpact unit of claim 1, wherein the fastening member comprises an L-shaped body, a base of which is coupled to the armrest and a portion orthogonal to the base is aligned with and extends a portion of a length of the one of the pair of armrests.

3. The backpack of claim 2, wherein the cross-member is a first cross-member and the apparatus further comprising a pair of second cross-members respective ones of the pair of second cross-members coupling the ends of the U-shaped front leg frame and the ends of the U-shaped back leg frame, wherein the portion of the fastening member orthogonal to the base is disposed between the U-shaped front leg frame and the U-shaped back leg frame and has an opening therethrough, and one of the pair of second cross-members is disposed through the opening.

4. The backpack unit of claim 1, wherein the cross-member is a first cross-member and the apparatus further comprises:

a pair of second cross-members respective ones of the pair of second cross-members coupling the ends of the U-shaped front leg frame and the ends of the U-shaped back leg frame, wherein the fastening member is disposed between the U-shaped front leg frame and the U-shaped back leg frame, wherein the fastening member has at least one opening therethrough, and wherein one of the pair of second cross-members is disposed through the at least one opening.

5. The backpack unit of claim 4, wherein the fastening member comprises a first fastening member, the apparatus further comprising a second fastening member coupled to the other of the pair of armrests and disposed between the U-shaped front leg frame and the U-shaped back leg frame, the second fastening member having at least one opening therethrough, wherein the other of the pair of second cross members is disposed through the at least one opening of the second fastening member.

6. The backpack unit of claim 5, wherein the pair of second cross members are linearly aligned.

* * * * *